US007796930B2

(12) United States Patent
Inomata

(10) Patent No.: US 7,796,930 B2
(45) Date of Patent: Sep. 14, 2010

(54) ANTI-TONER-ADHESION MECHANISM AND SHEET CONVEYING APPARATUS AND METHOD THEREOF

(75) Inventor: Toshiya Inomata, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 727 days.

(21) Appl. No.: 11/694,574

(22) Filed: Mar. 30, 2007

(65) Prior Publication Data

US 2007/0231024 A1 Oct. 4, 2007

(30) Foreign Application Priority Data

Mar. 31, 2006 (JP) ..... 2006-098528

(51) Int. Cl.
*G03G 15/20* (2006.01)

(52) U.S. Cl. ..... 399/322; 399/405

(58) Field of Classification Search ..... 399/322, 399/405, 406

See application file for complete search history.

(56) References Cited

U.S. PATENT DOCUMENTS 6,330,419 B1 * 12/2001 Sano et al. ..... 399/322
6,542,711 B2 * 4/2003 Matsunai ..... 399/322
7,299,000 B2 * 11/2007 Taira et al. ..... 399/322

FOREIGN PATENT DOCUMENTS

| | | |
|---|---|---|
| JP | 05-341687 | 12/1993 |
| JP | 08-006415 | 1/1996 |
| JP | 2003267610 | 9/2003 |
| JP | 2004157462 | 6/2004 |

* cited by examiner

*Primary Examiner*—William J Royer
(74) *Attorney, Agent, or Firm*—Turocy & Watson, LLP

(57) ABSTRACT

A technique of preventing toner from adhering to a guide which guides a change of a conveying direction of a paper by the paper on which a toner image is formed contacting with the guide is provided. The technique includes: a concave guide, having a concave guide surface, which guides conveyance of a paper so as to change a conveyance direction of the conveyed paper; and a guiding roller provided in the vicinity of a position on the concave guide surface of the concave guide where a front edge of the paper conveyed toward the concave guide abuts so as to have a roller surface project from the concave guide surface.

15 Claims, 6 Drawing Sheets

ANTI-TONER-ADHESION MECHANISM AND SHEET CONVEYING APPARATUS AND METHOD THEREOF

BACKGROUND OF THE INVENTION

1. Field of the Invention

The present invention relates to a technique of preventing toner from adhering to a guide which guides a change of a conveying direction of paper by the paper on which a toner image is formed contacting with the guide.

2. Description of the Related Art

There is a known paper conveying mechanism including a fixing unit which includes a fixing roller, a heating roller placed adjacent to the fixing roller for generating heat, and a pressing roller placed in pressure contact with the fixing roller, the fixing unit passing a paper to which a toner image is transferred between the fixing roller and the heating roller, and fixing the toner image by applying heat and pressure to the paper, and a pair of guides placed on a downstream side of the fixing unit, which include a concave guide surface having a concave curved shape and a convex guide surface having a convex curved shape, respectively, for guiding conveyance of the paper from both surfaces so as to change the conveying direction. The guide having the convex guide surface of the pair of the guides is arranged with a plurality of rotational rollers with predetermined intervals between each of the rollers in a width direction. A circumference surface of the rollers projects from the convex guide surface. A downstream side of the pair of the guides is arranged with a paper delivery roller, which ejects the paper to the outside.

Immediately after the toner image is fixed on the paper by the fixing unit, the paper is delivered to between the pair of the guides while the paper is still hot. A front surface of the paper abuts a circumference surface of the rollers, and the paper is conveyed to the delivery roller with guidance of both of the guide surfaces with a little friction force applied from the convex guide surface by the rotation of the rollers.

However, in the conventional paper conveying mechanism, the fixing roller is soft and the pressing roller is hard. Therefore, the paper is discharged from between the rollers after a shape of the paper is curved toward a direction of the pressing roller. The guide having the concave guide surface is placed on a pressing roller side and the guide having the convex guide surface is placed on a fixing roller side. Therefore, after a front edge of a back surface of the paper abuts the concave guide surface, the paper is conveyed by being in contact with the concave guide surface. There is a case that toner adhered to a transfer roller is adhered to the back surface of the paper when the paper passes the transfer roller which transfers the toner image to the paper. In addition, in a both side printing, the toner image is formed also on the back surface of the paper. Therefore, in a state where the paper is still hot immediately after the paper is discharged from the fixing unit, the toner on the back surface of the paper is in a state where the fixing is unstable, just like the front surface, and the toner is adhered to the concave guide surface.

In addition, the guide is formed by a high temperature resistant material, and such material is not capable of forming a smooth surface. Therefore, the concave guide has a surface with large friction, and is in a state where the toner easily adheres to the guide due to heat of the guide as well. For this reason, the toner is accumulated in the concave guide surface and the paper may jam the mechanism.

As an example of a paper conveying mechanism having a form different from above, there is a configuration in which a free roller is provided on a rear edge side of a plurality of ribs extending to a downstream side of conveyance, the ribs connected to a paper peeling guide member positioned at the back of the heating roller, the fixed paper is smoothly fed along a periphery of the free roller which freely rotates, and the toner on the paper is prevented from adhering to the edge of the ribs (for example, refer to Jpn. Pat. Appln. Laid-Open Publication No. 8-6415).

In addition, as a different example, there is a configuration in which a fixed paper is peeled from a fixing roller by a separation pawl, a paper delivery roller and a driven roller driven in pressure contact by the paper delivery roller convey the paper through a paper conveying path after fixing, and the driven roller is provided projecting from a second guide unit including a plurality of ribs (for example, refer to Jpn. Pat. Appln. Laid-Open Publication No. 5-341685).

However, even in the conventional technique described above, although conveying friction is reduced by the roller with respect to the front surface of the paper on which the toner image is fixed, the conventional technique does not have any function of reducing the conveying friction with respect to the back surface of the paper. Therefore, in the case where the toner is adhered to the back surface of the paper, the toner is adhered to the paper conveying mechanism and accumulated, and the paper may jam the mechanism.

SUMMARY OF THE INVENTION

An object of the present invention is to provide a technique of preventing toner from adhering to a guide which guides a change of a conveying direction of paper by the paper on which a toner image is formed contacting with the guide.

In order to achieve the above object, according to an aspect of the present invention, there is provided a paper conveying mechanism comprising: a concave guide, having a concave guide surface, which guides conveyance of paper so as to change a conveyance direction of conveyed paper; and a guiding roller provided in the vicinity of a position on the guide surface of the concave guide where a front edge of the paper conveyed toward the concave guide abuts, so as to have a roller surface project from the guide surface.

In addition, according to an aspect of the present invention, there is provided an image forming device comprising: a paper conveying mechanism with a configuration as described above; and a conveying unit conveying a paper guided by the guide surface of the concave guide to an image forming unit, which forms a toner image on the paper.

In addition, according to an aspect of the present invention, there is provided a paper conveying mechanism comprising: a first guiding means, having a concave guide surface, for guiding conveyance of a paper so as to change a conveying direction of conveyed paper; and a second guiding means, having a roller shape provided in the vicinity of a position on the guide surface of the first guiding means, the position where a front edge of the paper conveyed toward the first guiding means abuts, so as to have a roller surface project from the guide surface.

In addition, according to an aspect of the present invention, there is provided an image forming device comprising: a paper conveying mechanism with the configuration as described above; and a conveying means for conveying paper guided by the guide surface of the first guiding means to an image forming unit which forms a toner image on the paper.

In addition, according to an aspect of the present invention, there is provided a paper conveying method comprising: by a concave guide having a concave guide surface, guiding conveyance of a paper so as to change a conveying direction of conveyed paper; and guiding the paper guided by the concave guide by a guiding roller, the guiding roller being provided in the vicinity of a position on the guide surface of the concave guide where a front edge of the paper conveyed toward the concave guide abuts, so as to have a roller surface project from the guide surface.

DESCRIPTION OF THE EMBODIMENTS

Hereinafter, an embodiment of the present invention will be described with reference to the accompanying drawings.

Figure 1:
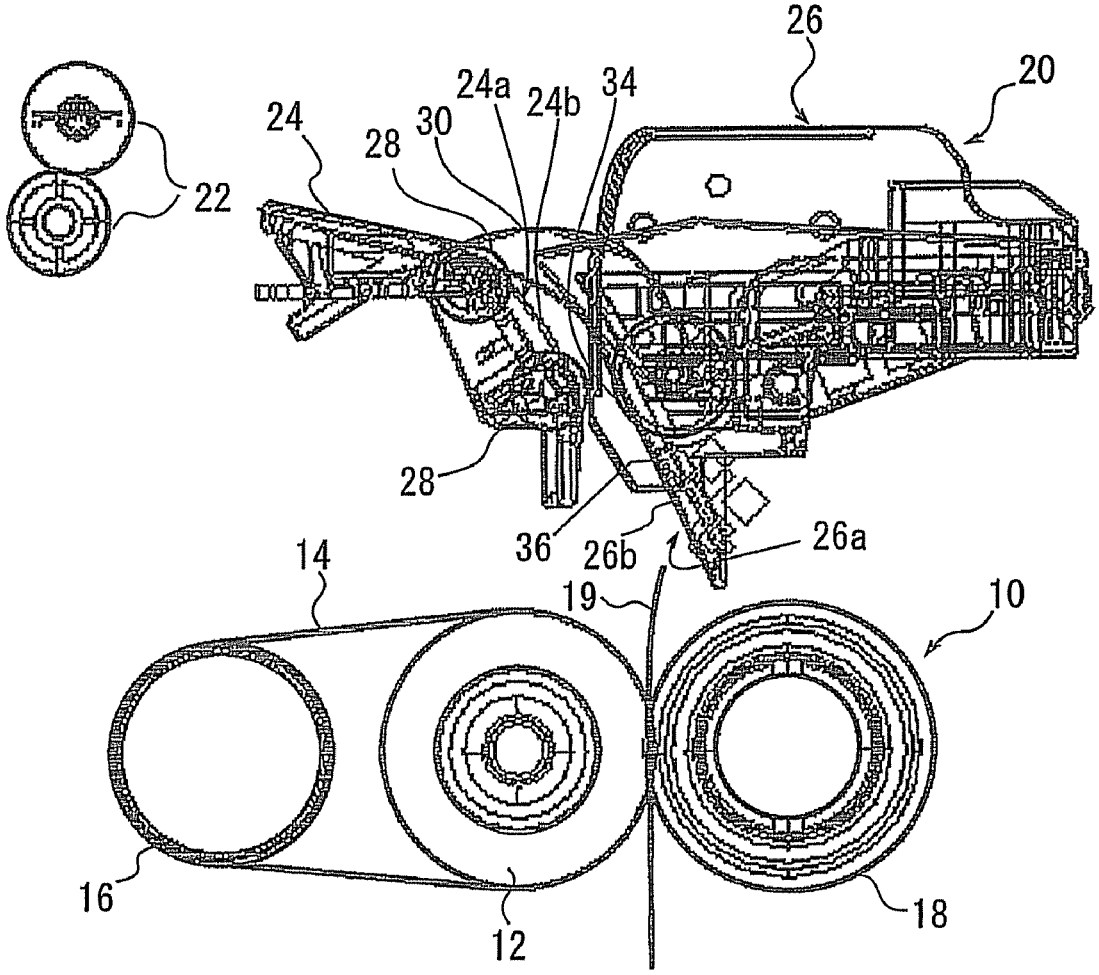
FIG. 1 is a configuration diagram showing a paper conveying mechanism according to an embodiment of the present invention.
Figure 2:
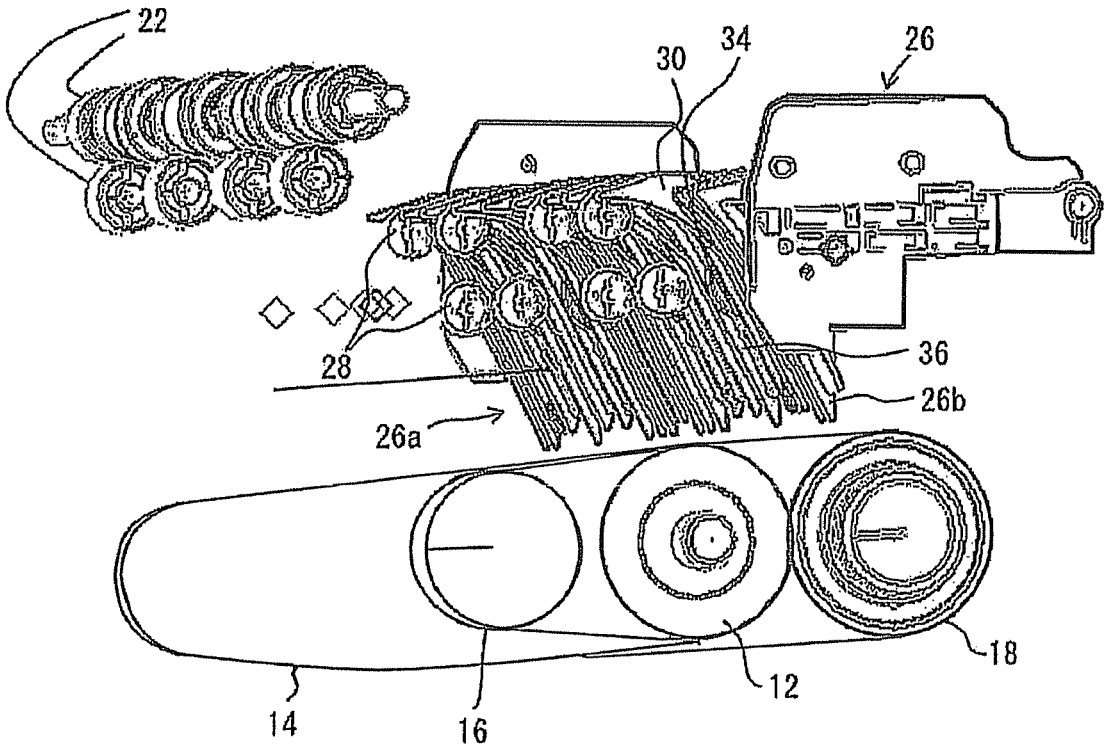
FIG. 2 is a perspective view showing the paper conveying mechanism according to the embodiment.
Figure 3:
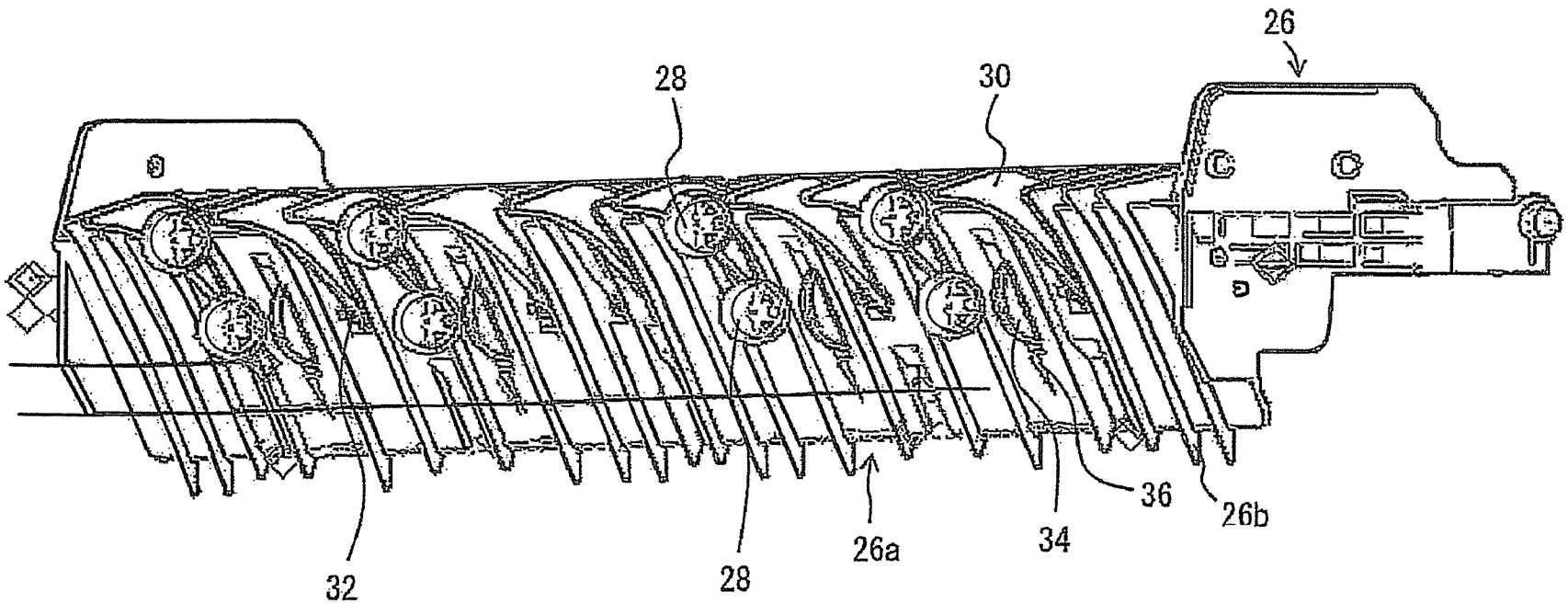
FIG. 3 is a perspective view of a second guide when viewed from a direction of a first roller of a first guide.
Figure 4:
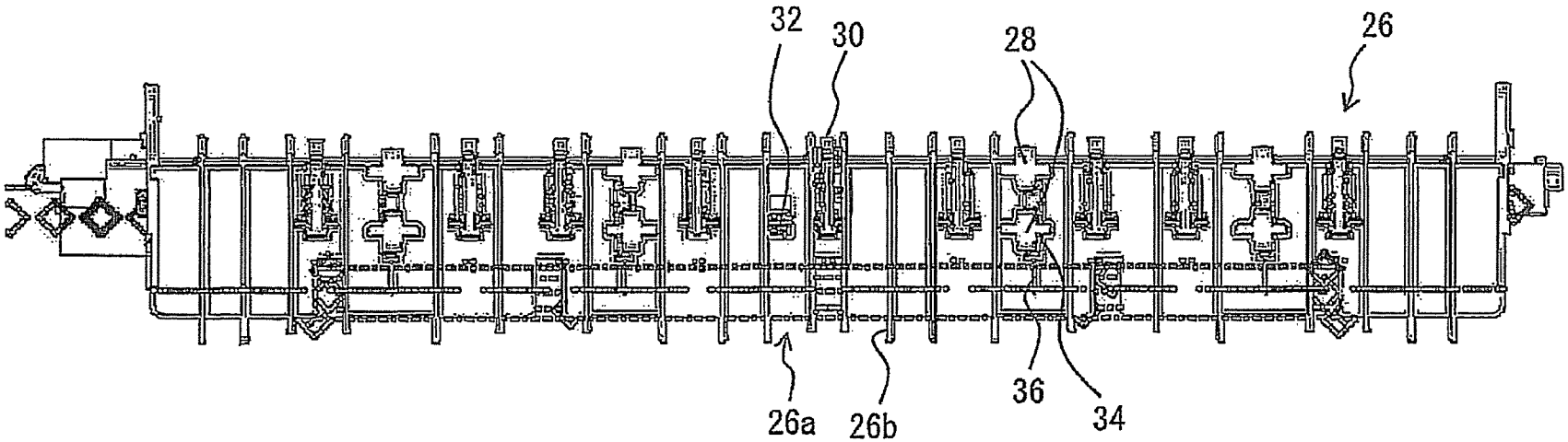
FIG. 4 is a front view of the second guide when viewed from the direction of the first roller of the first guide.
Figure 5:
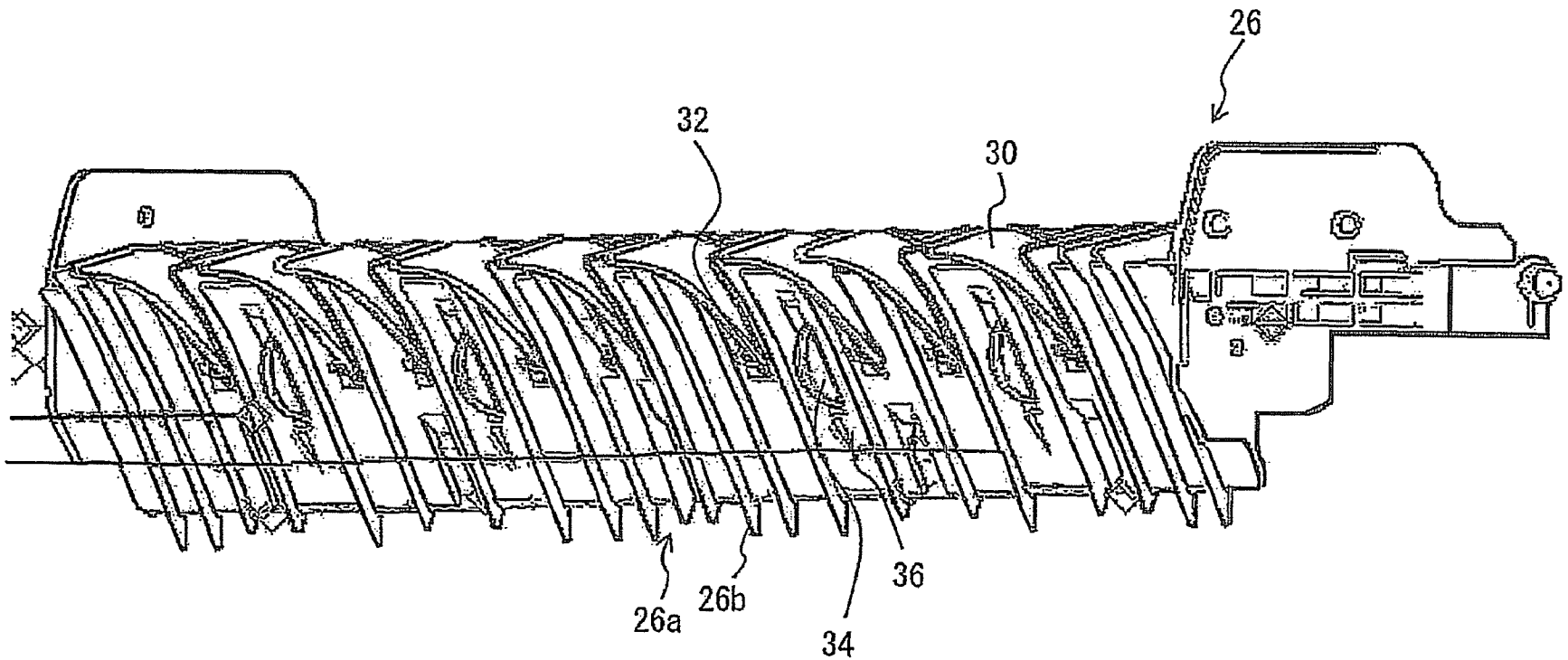
FIG. 5 is a perspective view of the second guide when viewed from a direction of a concave guide surface.
Figure 6:
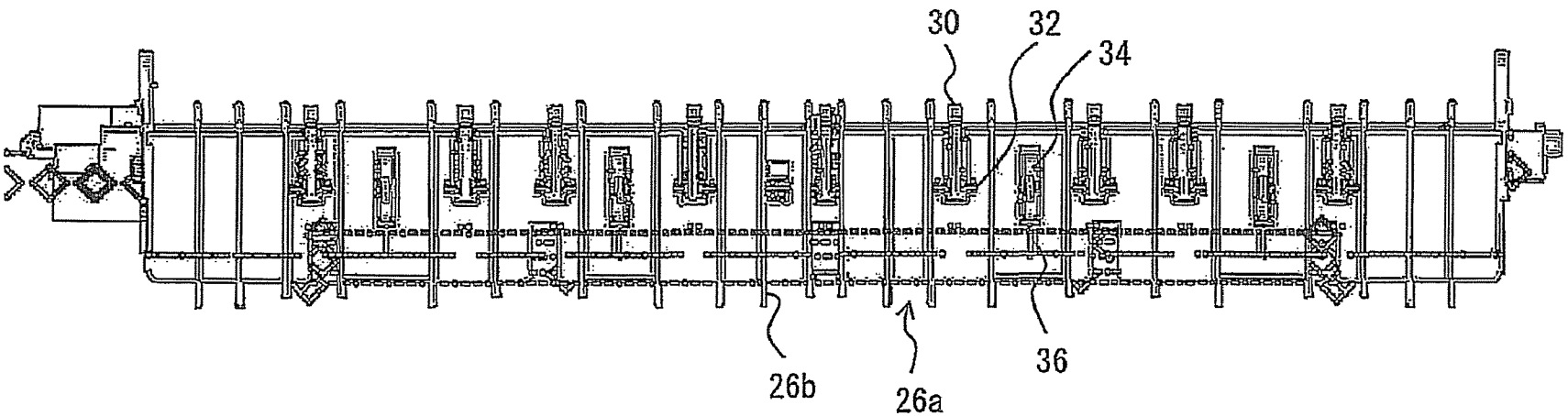
FIG. 6 is a front view of the second guide when viewed from the direction of the concave guide surface.

FIG. 1 is a configuration diagram showing a paper conveying mechanism according to the present embodiment. FIG. 2 is a perspective view showing the paper conveying mechanism according to the present embodiment. FIG. 3 is a perspective view of a second guide when viewed from a direction of a first roller of a first guide. FIG. 4 is a front view of the second guide when viewed from the direction of the first roller of the first guide. FIG. 5 is a perspective view of the second guide when viewed from a direction of a concave guide surface. FIG. 6 is a front view of the second guide when viewed from the direction of the concave guide surface.

A fixing unit 10 includes a fixing roller 12 and a heating roller 16 placed adjacent to the fixing roller 12 and connected to the fixing roller 12 by a belt 14, and a pressing roller 18 placed in pressure contact with the fixing roller 12. A lamp for heating the heating roller 16 is provided inside the heating roller 16. The fixing roller 12 contacts the pressing roller 18 with the belt 14 therebetween, and has a certain nip width. The fixing roller 12 is set to have a lower degree of hardness than the pressing roller 18. Therefore, the fixing roller 12 is configured to deform more than the pressing roller 18 at a nip position. The fixing roller 12 is heated to be about 170° C. and the pressing roller 18 is heated to be about 130° C. due to an influence from the heating roller 16. By passing a paper 19 to which a toner image is transferred between the fixing roller 12 and the pressing roller 18, heat and pressure are applied to the paper 19 to fix the toner image. The fixed paper is sent out after the conveying direction is changed a little to a right direction in FIG. 1 due to a difference in the degree of hardness between the fixing roller 12 and the pressing roller 18.

On a downstream side of the fixing unit 10, a paper conveying mechanism 20 is arranged. The paper conveying mechanism 20 guides conveyance of the paper 19 so as to change the conveying direction of the paper 19 ejected from the fixing unit 10. On a downstream side of the paper conveying mechanism 20, a delivery roller 22 for conveying the paper 19 to a delivery tray (not shown) is arranged. The conveying direction changed by the paper conveying mechanism 20 is a direction opposite from the conveying direction changed by the fixing unit 10.

The paper conveying mechanism 20 includes a pair of guides 24 and 26. The pair of guides 24 and 26 are heated due to an influence of the heating roller 16 and need to resist a high temperature, and are configured with a material with large friction, a front surface of which cannot be formed to be smooth.

The first guide 24 placed on a side facing a front surface of the paper 19 on which the toner image is formed among the pair of the guides 24 and 26 includes a convex guide surface 24*a* having a plurality of ribs 24*b* of a convex surface in a width direction. The first guide 24 is provided with four of first rollers 28 in two positions on the upstream side and on a downstream side in a direction of conveying the paper 19 with predetermined intervals between each of the first rollers 28 in a width direction. In order that the front surface of the paper 19 does not contact the convex guide surface 24*a* configured with a material with large friction, a circumference surface of the first rollers 28 projects a little from the convex guide surface 24*a*. The paper 19 can be conveyed along the circumference surface of the first rollers 28 by a rotation of the first rollers 28. An external diameter of the first roller 28 is ϕ10.

As shown in FIGS. 5 and 6, on the other hand, the second guide (concave guide, first guiding means) 26 placed on a side facing the back surface of the paper 19 among the pair of the guides 24 and 26 includes a concave guide surface 26*a* having a plurality of ribs 26*b* having a concave curve in a width direction. In an upper edge portion of the second guide 26, nine of gates 30 projecting to a direction of the first guide 24 are arranged with predetermined intervals between the gates 30 in a width direction. An end of each of the gates 30 is supported by a supporting axis 32 arranged in a width direction of the second guide 26. As shown in FIGS. 3 and 4, the supporting axis 32 supports in a freely rotatable manner second rollers (guiding rollers, second guiding means) 34 arranged in positions overlapping the first rollers 28, respectively, along a width direction of the second guide 26. That is, the second rollers 34 are provided in the vicinity of a position on a guide surface of a concave guide where a front edge of the paper conveyed toward the concave guide abuts, in a manner that a roller surface projects from the guide surface. The second guide 26 with the configuration as described above guides the conveyance of the paper so as to change the conveying direction of the conveyed paper.

A circumference surface of the second rollers 34 projects a little from the concave guide surface 26*a* in order that the back surface of the paper 19 does not contact the concave guide surface 26*a* configured with a material with large friction. The paper 19 can be conveyed along the circumference surface of the second rollers 34 by a rotation of the second rollers 34. An external diameter of the second rollers 34 is ϕ17 which is larger than an external diameter of the first rollers 28. On a lower part of each of the second rollers 34 of the concave guide surface 26*a*, a protrusion (protrusion portion, third guide means) 36, a degree of projection of which becomes larger in an inclined manner toward a direction of the second rollers 34, is formed. In other words, the protrusion 36 is provided on the concave guide surface 26*a* in the vicinity of an upstream side of the second rollers 34 in the direction of conveying the paper 19, and is provided so as to have the degree of protrusion becomes larger in an inclined manner toward the second roller 34. In addition, a fluorine coating is applied to an external surface (roller surface) of the second rollers 34 in order to improve slipperiness of the paper 19. Alternatively, the second rollers 34 may be configured with fluorine resin.

Next, an action of the present embodiment will be described. The paper 19 to which the toner image is transferred by a transfer roller (not shown) is passed between the fixing roller 12 and the pressing roller 18 in order that heat and pressure are applied to the paper 19 to fix the toner image. However, since the fixing roller 12 is soft and the pressing roller 18 is hard, when the paper 19 is discharged from between the rollers 12 and 18, the paper 19 is curved to a direction of the pressing roller 18. For this reason, the front edge of the paper 19 is directed to a direction of the second guide 26 and abuts the protrusion 36, and the back surface of the paper 19 is guided by the protrusion 36 to reach the second rollers 34. Thereafter, the back surface of the paper 19 is smoothly conveyed along a periphery of the second rollers 34 by a rotation of the second rollers 34. At this time, the paper 19 is conveyed in a manner that the back surface thereof contacts only the protrusion 36 and the periphery of the second rollers 34, and is in a state that there is a space between the paper 19 and the concave guide surface 26*a*.

There is a case where the toner applied to the transfer roller is adhered to the back surface of the paper 19. There also is a case where the toner is adhered to the back surface of the paper 19 if the toner image is formed on the back surface as well in both side printing. In such cases, fixing of toner is unstable on the paper 19 having a high temperature immediately after the paper is discharged from the fixing unit 10, and the toner is easily adhered to the concave guide surface 26*a*. In addition, the concave guide surface 26*a* having large friction is heated which makes the toner even more easily adhered to the concave guide surface 26*a*. Therefore, if the back surface of the paper 19 assumes to be conveyed while contacting the concave guide surface 26*a*, there is a possibility that the toner is adhered to the concave guide surface 26*a*. However, since the back surface of the paper 19 has no chance to rub against the concave guide surface 26*a*, the paper 19 is prevented from jamming the mechanism 20 due to the toner adhering to and accumulated on the concave guide surface 26*a*. In the present embodiment, a case where the concave guide 26 is positioned in the vicinity of a downstream side of the fixing unit 10 for heating and fixing the toner image on the paper 19 in the direction of conveying the paper 19 is exemplified. However, the present invention is not limited thereto. The concave guide 26 may be placed in a position other than the position in the vicinity of a downstream side of the fixing unit 10. In this case as well, an ill effect of adherence of the toner and so forth due to the toner image on the paper 19 rubbed against the concave guide 26 can be avoided.

In the embodiment described above, the external diameter of the first rollers 28 is set to be Φ10 and the external diameter of the second rollers 34 is set to be Φ17. However, the present invention is not limited thereto, and these external diameters can be changed appropriately. However, since the second rollers 34 easily have a stain adhering thereto, the external diameter of the second rollers 34 desires to be F 14 or more.

In the embodiment described above, the first rollers 28 and the second rollers 34 are provided in four positions on both guides 24 and 26 in a width direction. However, the present invention is not limited thereto. The number of the first rollers 28 and the second rollers 34 can be increased or decreased in an appropriate manner in accordance with a width dimension of the guides 24 and 26.

Further, in the embodiment described above, the second rollers 34 are provided at the supporting axis 32 of the gates 30. However, the present invention is not limited thereto. The second rollers 34 may be provided in appropriate positions.

In addition, a plurality of the second rollers 34 are arranged in a direction substantially perpendicular to the direction of conveying the paper 19, and the second rollers 34 are configured to include at least two rollers arranged with an interval of placing narrower than a size of the paper 19 (for example, a size of a postcard) to be conveyed placed in a direction substantially perpendicular to the direction of conveying the paper 19.

As described above, according to the present embodiment, by providing rotatable rollers on the concave guide surface which the back surface of the paper contacts, the paper is smoothly conveyed with the back surface of the paper carried along the circumference surface of the rollers. Since the back surface of the paper does not contact the concave guide surface, even if the toner is adhered to the back surface of the paper, the toner does not adhere to the concave guide surface. Therefore, the paper is prevented from jamming the mechanism due to the toner accumulated on the concave guide surface.

Needless to say, an image forming device including the paper conveying mechanism with the configuration as described above and a conveying roller (conveying unit) for conveying the paper guided by the concave guide surface of the concave guide to an image forming unit for forming the toner image on the paper can be provided.

In addition, according to the present embodiment, the external diameter of the rollers are made to be F 14 or more, which makes an angle of the rollers abutting the paper becomes larger, therefore, friction between the rollers and the paper can be reduced.

Needless to say, an image forming device including the paper conveying mechanism with the configuration as described above and a conveying roller (conveying unit) for conveying the paper guided by the guide surface of the concave guide to an image forming unit for forming the toner image on the paper can be provided.

Although the present invention has been described in detail by using a specific embodiment, it is obvious to one skilled in the art that a variety of modifications and amendments can be made without departing from the spirit and the scope of the present invention.

As described above in detail, according to the present invention, a technique of preventing toner from adhering to a guide which guides a change of a conveying direction of a paper by the paper on which a toner image is formed contacting with the guide can be provided.

What is claimed is:

1. A paper conveying mechanism comprising:

a concave guide, having a concave guide surface, which guides conveyance of a paper so as to change a conveyance direction of conveyed paper; and a guiding roller provided in the vicinity of a position on the concave guide surface of the concave guide where a front edge of the paper conveyed toward the concave guide abuts so as to have a roller surface project from the concave guide surface.

2. The paper conveying mechanism according to claim 1, wherein the concave guide is positioned in a fixing unit in the vicinity of a downstream side in a paper conveying direction, the fixing unit heating and fixing a toner image on the paper.

3. The paper conveying mechanism according to claim 1, further comprising a protrusion unit provided on the concave guide surface in the vicinity of an upstream side of the guiding roller in the paper conveying direction, and a degree of protrusion of the protrusion unit becomes larger in an inclined manner toward the guiding roller.

4. The paper conveying mechanism according to claim 1, wherein a plurality of the guiding rollers are arranged in a direction substantially perpendicular to the paper conveying direction, the guiding rollers including at least two rollers arranged with placement intervals narrower than a size of the paper to be conveyed in the direction substantially perpendicular to the paper conveying direction.

5. The paper conveying mechanism according to claim 1, wherein the guiding rollers have a roller surface which is fluorine coated.

6. A paper conveying mechanism comprising:

first guiding means having a concave guide surface, for guiding conveyance of a paper so as to change a conveying direction of conveyed paper; and second guiding means having a roller shape provided in the vicinity of a position on the concave guide surface of the first guiding means, the position where a front edge of the paper conveyed toward the first guiding means abuts, so as to have a roller surface project from the concave guide surface.

7. The paper conveying mechanism according to claim 6, wherein the first guiding means is positioned in the vicinity of a downstream side of a fixing unit in a paper conveying direction, the fixing unit for heating and fixing the toner image on the paper.

8. The paper conveying mechanism according to claim 6, further comprising third guiding means provided on the concave guide surface in the vicinity of an upstream side of the second guiding means in the paper conveying direction, and a degree of protrusion of the third guiding means becomes larger in an inclined manner toward the second guiding means.

9. The paper conveying mechanism according to claim 6, wherein a plurality of the second guiding means are arranged in a direction substantially perpendicular to the paper conveying direction, the second guiding means including at least two rollers arranged with placement intervals narrower than a size of the paper to be conveyed in the direction substantially perpendicular to the paper conveying direction.

10. The paper conveying mechanism according to claim 6, wherein the second guiding means has a roller surface which is fluorine coated.

11. A paper conveying method comprising:

by a concave guide having a concave guide surface, guiding conveyance of a paper so as to change a conveying direction of conveyed paper; and guiding the paper guided by the concave guide by a guiding roller, the guiding roller being provided in the vicinity of a position on the concave guide surface of the concave guide where a front edge of the paper conveyed toward the concave guide abuts so as to have a roller surface project from the concave guide surface.

12. The paper conveying method according to claim 11, wherein the concave guide is positioned in a fixing unit in the vicinity of a downstream side in a paper conveying direction, the fixing unit heating and fixing a toner image on the paper.

13. The paper conveying method according to claim 11, wherein guiding the paper toward the guiding roller by a protrusion unit, the protrusion unit being provided on the concave guide surface in the vicinity of an upstream side of the guiding roller in the paper conveying direction, and a degree of protrusion of the protrusion unit becoming larger in an inclined manner toward the guiding roller.

14. The paper conveying method according to claim 11, wherein a plurality of the guiding rollers are arranged in a direction substantially perpendicular to the paper conveying direction, the guiding rollers including at least two rollers arranged with placement intervals narrower than a size of the paper to be conveyed in the direction substantially perpendicular to the paper conveying direction.

15. The paper conveying method according to claim 11, wherein the guiding rollers have a roller surface which is fluorine coated.

* * * * *